US010701479B2

(12) United States Patent
Dekel

(10) Patent No.: US 10,701,479 B2
(45) Date of Patent: Jun. 30, 2020

(54) HEADPHONE OR EARPHONE DEVICE

(71) Applicant: NOVEL ACOUSTICS LTD, Netanya (IL)

(72) Inventor: Boaz Dekel, Even Yehuda (IL)

(73) Assignee: NOVEL ACOUSTICS LTD., Netanya (IL)

( * ) Notice: Subject to any disclaimer, the term of this patent is extended or adjusted under 35 U.S.C. 154(b) by 0 days.

(21) Appl. No.: 16/066,739

(22) PCT Filed: Jan. 5, 2017

(86) PCT No.: PCT/IL2017/050015
§ 371 (c)(1),
(2) Date: Jun. 28, 2018

(87) PCT Pub. No.: WO2017/118981
PCT Pub. Date: Jul. 13, 2017

(65) Prior Publication Data

US 2019/0020947 A1 Jan. 17, 2019

Related U.S. Application Data

(60) Provisional application No. 62/274,814, filed on Jan. 5, 2016.

(51) Int. Cl.
*H04R 1/02* (2006.01)
*H04R 1/28* (2006.01)
(Continued)

(52) U.S. Cl.
CPC ..... *H04R 1/2865* (2013.01); *H04R 1/1008* (2013.01); *H04R 1/1016* (2013.01); *H04R 1/1058* (2013.01)

(58) Field of Classification Search
CPC ..... H04R 9/06; H04R 1/30; H04R 1/2861; H04R 1/2865; H04R 1/28
(Continued)

(56) References Cited

U.S. PATENT DOCUMENTS 3,473,625 A * 10/1969 Heisrath ..... H04R 1/2888 381/336
4,655,315 A * 4/1987 Saville ..... H04R 1/2857 181/153
(Continued)

FOREIGN PATENT DOCUMENTS

CN 1438818 A 8/2003
CN 102014321 A 4/2011
(Continued)

OTHER PUBLICATIONS

International Search Report for PCT/IL12017/050015, dated Apr. 5, 2017 (4 pages).
(Continued)

*Primary Examiner* — Suhan Ni
(74) *Attorney, Agent, or Firm* — Roach, Brown, McCarthy & Gruber, P.C.; Kevin D. McCarthy

(57) ABSTRACT

An earphone/headphone device, and a housing for such device are presented. The housing has proximal and distal ends defining respectively, a proximal closed-end portion and a distal open-end portion of the device, and comprises a sound source site for mounting a sound source in this site inside the housing, and an acoustic cavity extending from a back side of the sound source site and the proximal end portion of the housing. The acoustic cavity is configured to define a perpetual self-feeding closed-loop structure for propagation of backwave sound originated at the sound source site, such that the backwave sound is trapped and circulates in the closed-loop structure.

12 Claims, 8 Drawing Sheets

(51) Int. Cl.
*H04R 1/30* (2006.01)
*H04R 1/10* (2006.01)

(58) Field of Classification Search
USPC ..... 381/336, 340–341, 348–349, 353
See application file for complete search history.

(56) References Cited

U.S. PATENT DOCUMENTS

| | | | | |
|---|---|---|---|---|
| 4,819,761 | A * | 4/1989 | Dick | H04R 1/02 381/354 |
| 5,821,471 | A | 10/1998 | McCuller | |
| 6,078,676 | A | 6/2000 | Takenaka | |
| 6,356,643 | B2 * | 3/2002 | Yamagishi | H04R 1/2857 381/349 |
| 6,377,969 | B1 | 4/2002 | Orlando et al. | |
| 7,284,638 | B1 | 10/2007 | Sahyoun | |
| 8,205,712 | B2 * | 6/2012 | Dickie | H04R 1/2819 381/341 |
| 9,479,861 | B2 | 10/2016 | Bisset et al. | |
| 2001/0012372 | A1 | 8/2001 | Yamagishi et al. | |
| 2004/0084245 | A1 | 5/2004 | MacKin et al. | |
| 2004/0146172 | A1 | 7/2004 | Goswami et al. | |
| 2007/0284184 | A1 | 12/2007 | Krueger | |
| 2008/0006477 | A1 | 1/2008 | Huang | |
| 2009/0084624 | A1 | 4/2009 | Dickie | |

FOREIGN PATENT DOCUMENTS

| | | | |
|---|---|---|---|
| CN | 201904901 | U | 7/2011 |
| CN | 202385264 | U | 8/2012 |
| CN | 204578729 | U | 8/2015 |
| GB | 2290672 | A | 1/1996 |
| GB | 2298758 | A | 9/1996 |
| GB | 2333927 | A | 8/1999 |
| JP | 2005348190 | A | 12/2005 |
| WO | 2014147378 | A1 | 9/2014 |

OTHER PUBLICATIONS

Written Opinion of the International Searching Authority for PCT/IL2017/050015, dated Apr. 5, 2017 (5 pages).
Communication and Supplementary European Search Report for EP 17 73 5928; dated Feb. 21, 2020—7 pages.

* cited by examiner

HEADPHONE OR EARPHONE DEVICE

TECHNOLOGICAL FIELD AND BACKGROUND

The present invention relates to an earphone or headphone device configuration.

Earphone or headphone device is a mini speaker device that is configured to be inserted into the ear or worn over the ear, or worn adjacent to or in the vicinity of the ear, and is used for personal listening to an audio source. Earphone or headphone device, in contrast to a loudspeaker device which emits sound into the open space, e.g. room or environment (allowing anyone nearby to listen), is configured to allow a single user to listen to an audio source privately. Earphones or headphones are connected to a signal source (e.g. receiver, stereo amplifier, digital devices, like MP3 Player, phone or other handheld communication device, computer, radio, and portable music player), either directly or using a wireless technology.

The performance of an earphone or headphone device, similarly to that of a loudspeaker, is defined by the quality of its sound output (e.g. signal-to-noise; directionality, frequency response, harmonic distortion, etc.). More specifically, the earphone/headphone performance is evaluated by its ability to faithfully reproduce the wave form of the original source, i.e. a degree of match between the profile (frequency and amplitude profile) of a the earphone's output signal and the original source signal.

One of the common problems of earphones/headphones is associated with backwave distortion effects. The backwave distortions are associated with sound waves including those emerging from a back side of the sound waves source (an electroacoustic transducer or headphone driver), and also reflections/diffractions of sound waves from the inner surfaces of the earphone/headphone acoustic cavity and interactions between these reflected/refracted sound waves with the sound waves directly propagating from the loudspeaker towards the output of the earphone/headphone. Since such forward- and backward-generated sound waves are out of phase with each other, their interaction reduces the magnitude of the output signals (being listened). Further, since these sound waves travel different paths through the acoustic cavity, and accordingly arrive at the output of the cavity (and thus at the ear canal) at slightly different times, this introduces destructive phase and timing effects to the reproduced audio including comb-filtering and distortion resulting in loss of audio definition, separation, and overall deteriorated sound quality.

GENERAL DESCRIPTION

There is a need in the art for a novel approach in configuring an acoustic cavity of an earphone/headphone, to improve its performance.

In the description below, the terms "earphone" and "headphone" are used interchangeably having the same meaning. Also, in the description below, the terms "electroacoustic transducer", "headphone driver", "driver" and "speaker unit" are used interchangeably, all referring to a sound source, whose wave form is to be reproduced by the earphone/headphone device.

The present invention provides a novel configuration of the earphone or headphone device, in which backward generated sound waves are substantially prevented from interacting with forward generated sound waves and from reaching the listener.

In this connection, it should be understood that the terms "forward generated waves" and "backward generated waves" refer to sound/acoustic waves emerging in opposite directions, respectively, from a source/generator of the acoustic waves. Considering the proper operation of an earphone or headphone device, the forward generated waves are those to be output from the device to the listener, while the backward generated waves are those to be prevented from reaching the output of the earphone or headphone device.

The present invention, in its one broad aspect provides a housing for an earphone or headphone device. The housing has a proximal end and a distal end (with respect to a general direction of backwave sound waves propagation), which define, respectively, a proximal closed-end portion and a distal open-end portion of the device. The housing typically has a driver site intended for mounting a sound source (speaker unit) therein, and defines an acoustic cavity extending from a back side of the driver site and the proximal end portion of the housing. The acoustic cavity is configured according to the invention to define a perpetual self-feeding closed-loop structure for backwave sound originated at the driver site, such that the backwave sound is trapped and caused to circulate in the closed-loop structure.

In some embodiments, the acoustic cavity comprises such perpetual self-feeding closed-loop structure mounted therein. For example, this may be a spiral-like or helix-like structure extending from the back side of the loudspeaker site towards the proximal end of the housing.

In some embodiments, a portion of the housing containing the acoustic cavity has a substantially frustum-conical geometry with narrower and wider ends at, respectively, said back side of the sound source' site and the proximal end portion. In some examples, a portion of the housing containing the acoustic cavity has a funnel-like geometry, enclosing a portion of the housing containing the sound source' site.

In some embodiments, the portion of the housing containing the acoustic cavity has a perpetual self-feeding loop geometry/shape, thus defining by itself the perpetual self-feeding close-loop structure for the backwave sound circulation. For example, the acoustic cavity has a horn-like configuration, such that a region of the acoustic cavity at the back side of the sound source' site and the end portion of the housing defining, respectively, mouth and tail portions of the horn.

In some embodiments, the proximal end portion of the housing (e.g. tail portion of the horn) enters an inside of the acoustic cavity at a location thereof closer to said back side of the driver's site (e.g. at the mouth portion of the horn) and passes along a part of the acoustic cavity thereinside, thereby providing fluid coupling of the acoustic cavity with itself.

For example, the acoustic cavity may form a concentric configuration of the self-feeding perpetual loop structure.

In some embodiments, the mouth and the tail portions of the horn-like structure are stacked one above the other, creating a junction where the mouth and the tail portions merge into a single path, thereby forming the perpetual self-feeding loop structure.

As indicated above, in some embodiments, a portion of the housing containing the acoustic cavity has a funnel-like geometry, enclosing a portion of the housing containing the sound source' site. This may be implemented such that the mouth and the tail portions of the horn-like structure are stacked one above the other; or one in front of the other.

In all the above embodiments of the invention, the provision of the acoustic cavity comprising/defining the perpetual self-feeding loop structure causes the backward generated waves, as well as their reflections/diffractions, to enter such an infinite closed loop path to be trapped and circulate therein. By this, the backwave propagating waves are substantially prevented from interacting with the forward generated waves and from reaching the output of the device.

The above described configuration of the housing creates an acoustic cavity operating as closed-loop waveguide channel extending between the back side of the driver site and the proximal end portion of the housing.

According to another broad aspect of the invention, it provides an earphone or headphone device comprising the above described housing; and a sound source located inside the housing at the sound source' site; thereby defining a through path for propagation of forward generated sound waves from a front side of the sound source towards the distal open-end portion, and causing backward generated sound waves emerging the sound source at the back side thereof to circulate in the perpetual self-feeding closed-loop structure of the acoustic cavity.

BRIEF DESCRIPTION OF THE DRAWINGS

In order to better understand the subject matter that is disclosed herein and to exemplify how it may be carried out in practice, embodiments will now be described, by way of non-limiting examples only, with reference to the accompanying drawings, in which.

DETAILED DESCRIPTION OF EMBODIMENTS

The present invention provides a novel configuration of the earphone or headphone device, aimed at improving the device performance, by eliminating or at least significantly reducing the backwave distortion effects.

Figure 1A:
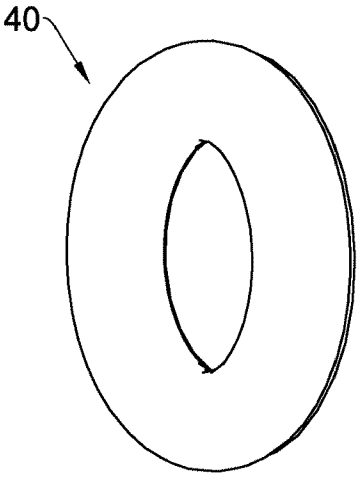
FIGS. 1A-1C and FIGS. 2A-2C illustrate two opposite-sides exploded views of the elements of an earphone/headphone device, according to some embodiments of the present invention.
Figure 1B:
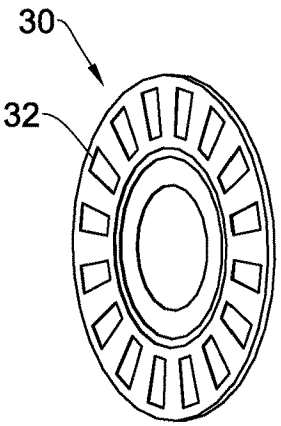
Figure 1C:
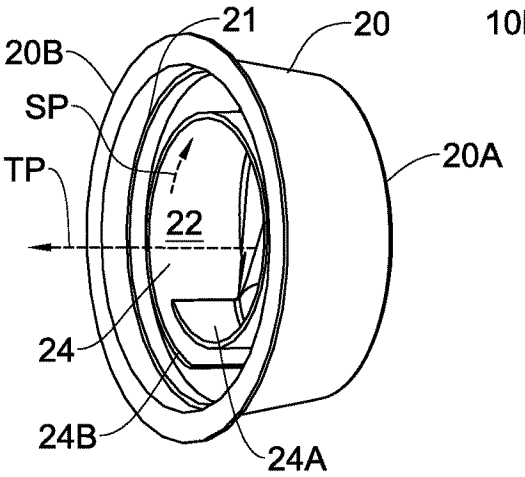
Figure 1D:
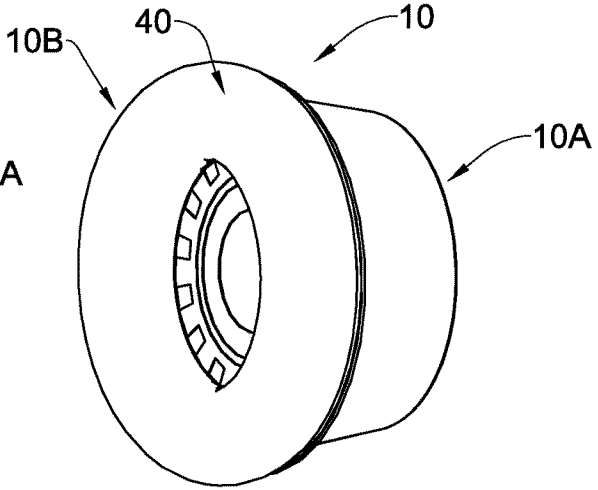
FIGS. 1D and 2D show the opposite-sides perspective views of the assembled earphone/headphone device.
Figure 2A:
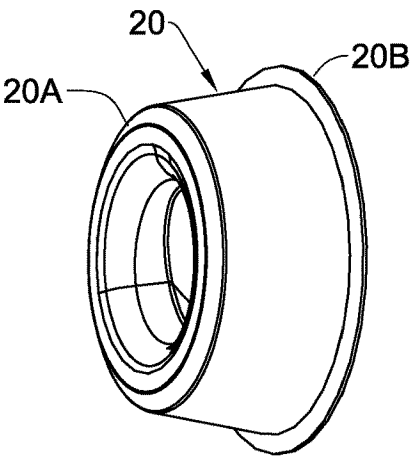
Figure 2B:
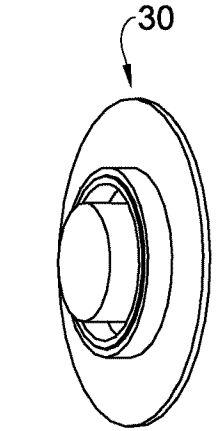
Figure 2C:
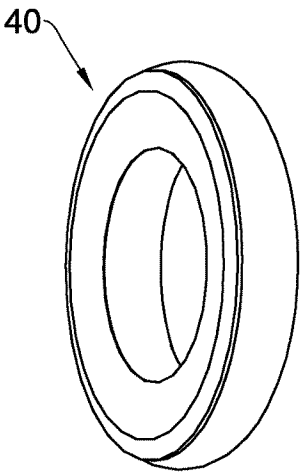
Figure 2D:
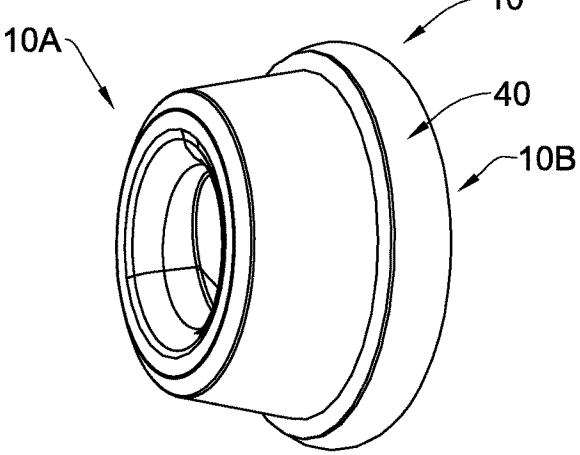

Reference is made to FIGS. 1A-1D, 2A-2D, 3 and 4 exemplifying the principles of the invention for configuring an earphone/headphone device. FIGS. 1D and 2D show the opposite views of the exemplary earphone/headphone device 10, while FIGS. 1A-1C and 2A-2C show respective exploded view of the device 10.

As shown, the earphone/headphone device 10 has a proximal end portion 10A which is a closed-end portion, and a distal portion 10B which is an open-end portion by which the device is mounted on/faces the user's ear. The earphone/headphone device 10 has a housing 20 having respective proximal and distal end portions 20A and 20B, and a sound source (driver) site 21 for mounting a sound source (speaker unit) 30 in said site inside the housing 20. It should be noted that pattern features 32 on the speaker unit 30 may constitute surface grooves (as exemplified in the figures) or perforations (not shown here). Preferably, also mountable on the housing at its distal open-end portion 20B is a toroid-like cushion (Ear Pad) 40.

Figure 3:
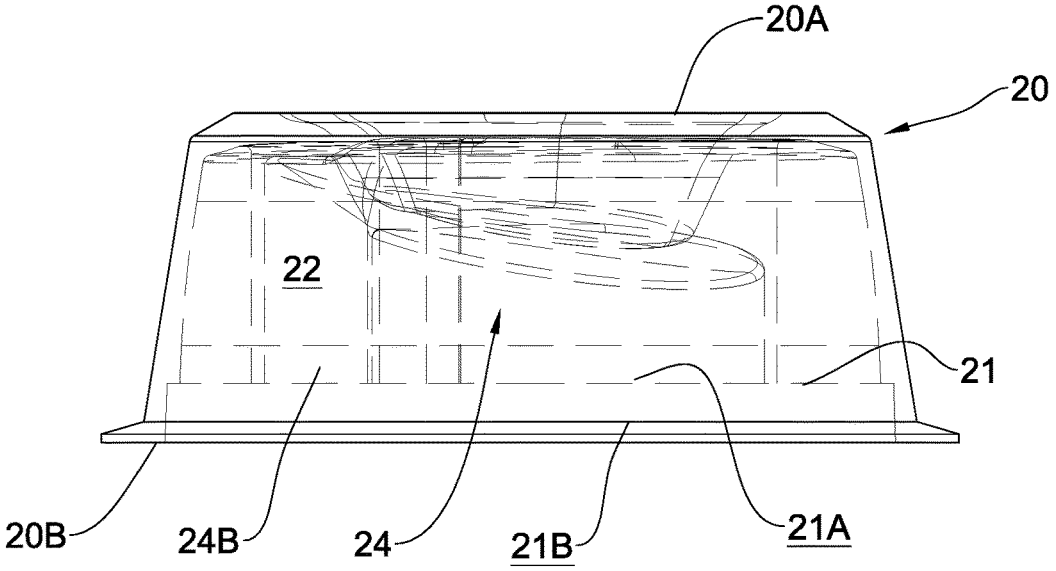
FIG. 3 is a cross-sectional side view of an example of the earphone/headphone housing of the present invention showing a spiral-like structure (partition) in an acoustic cavity of the housing.

As better shown in FIG. 3, illustrating schematically a cross-sectional side view of the housing 20, the sound source site 21 defines front and back sides 21B and 21A of the housing (acoustic enclosure) with respect to the sound source when mounted in the site 21. An acoustic cavity 22 is defined inside the housing extending from the back side 21A towards the proximal end portion 20A.

According to the invention, the acoustic cavity 22 of the housing 20 is configured to define a perpetual self-feeding loop structure 24. In the specific non-limiting example of FIGS. 1-4, such perpetual self-feeding loop structure 24 is a spiral- or helix-like structure formed by partition(s) made in the acoustic cavity therealong. As will be described below, in some other embodiments, the acoustic cavity itself (the corresponding portion of the housing) has the perpetual self-feeding loop geometry/configuration thus constituting such structure 24.

It should be noted that the invention is not limited to any specific configuration of structure 24, provides it defines the perpetual self-feeding loop geometry. Considering a single-segment or multi-segments spiral- or helix-like structure implementation, it should be understood that structure 24 of the perpetual self-feeding loop geometry may, similar to a generally spiral or helix element configuration, define a concentric path (e.g. along the central axis of the housing), but in distinction to the generally spiral or helix element, the perpetual self-feeding loop structure 24 of the invention is configured to define a substantially closed-loop or a substantially infinite length spiral path at the back side of the sound source site 21.

In this specific and not limiting example of FIGS. 1-4, the housing/enclosure 22 has a frustum-conical geometry with its narrower and wider proximal and distal portions 20A and 20B and defines the frustum-conical acoustic cavity 22, and the perpetual self-feeding loop structure 24 has a funnel-like or cup-like shape. It should, however, be noted that the invention is not limited to any specific geometry (shape and dimensions) of an outer surface of the housing, as well as that of the inner acoustic cavity 22.

Figure 4:
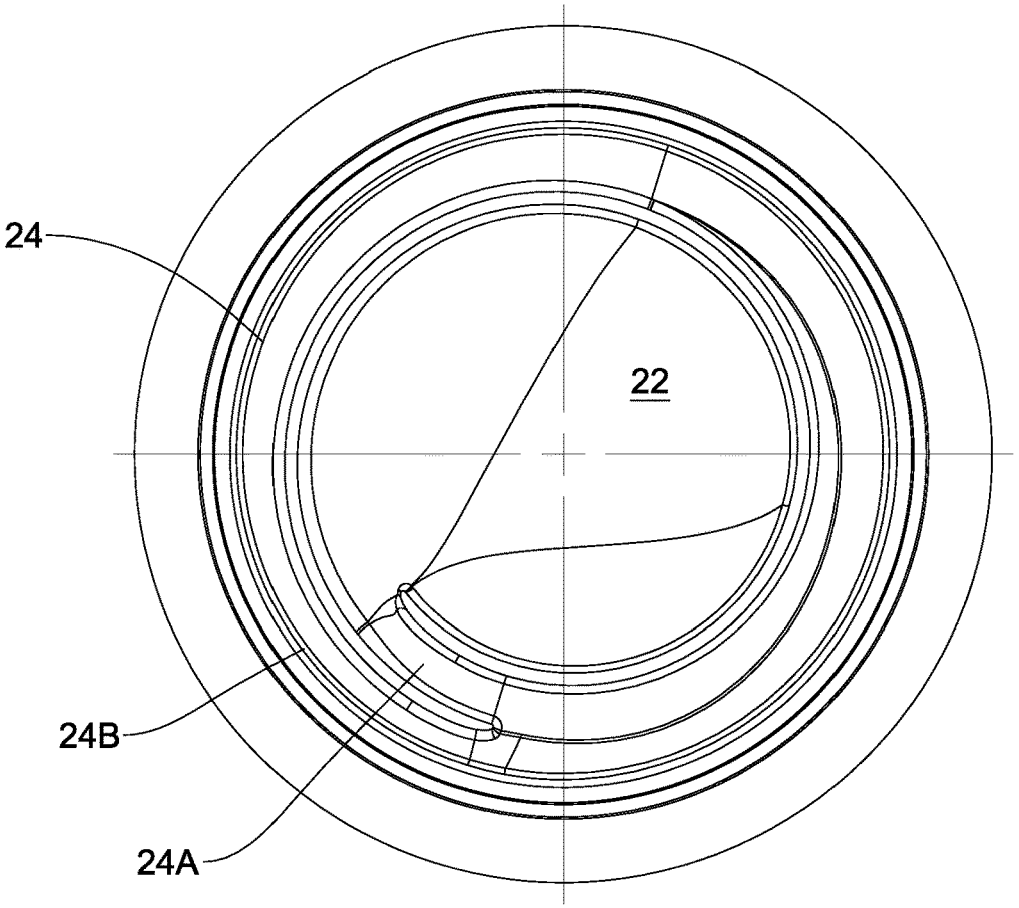
FIG. 4 is a top view of the earphone/headphone housing of FIG. 3.
Figure 5C:
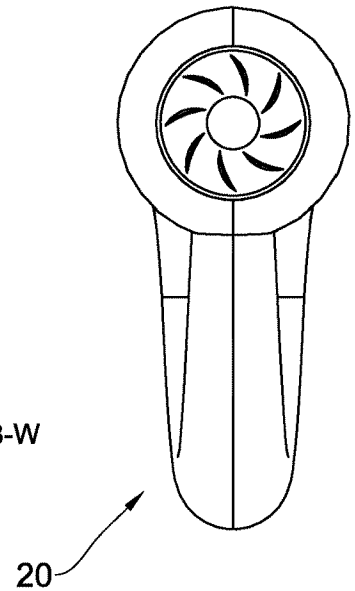
FIGS. 5A-5E illustrate various views of an earphone device according to some embodiments of the invention, utilizing the housing having horn-like configuration defining an acoustic cavity forming the concentric self-feeding perpetual loop.
Figure 5B:
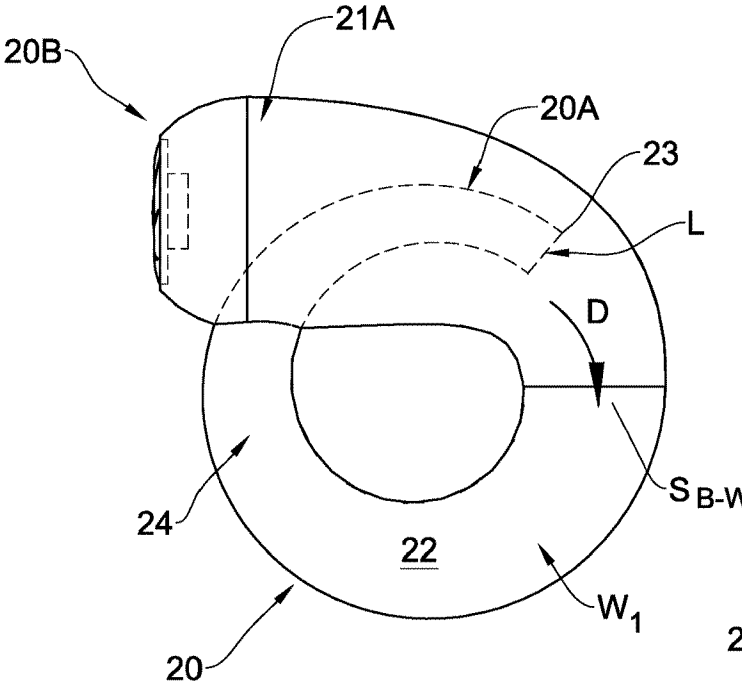
Figure 5A:
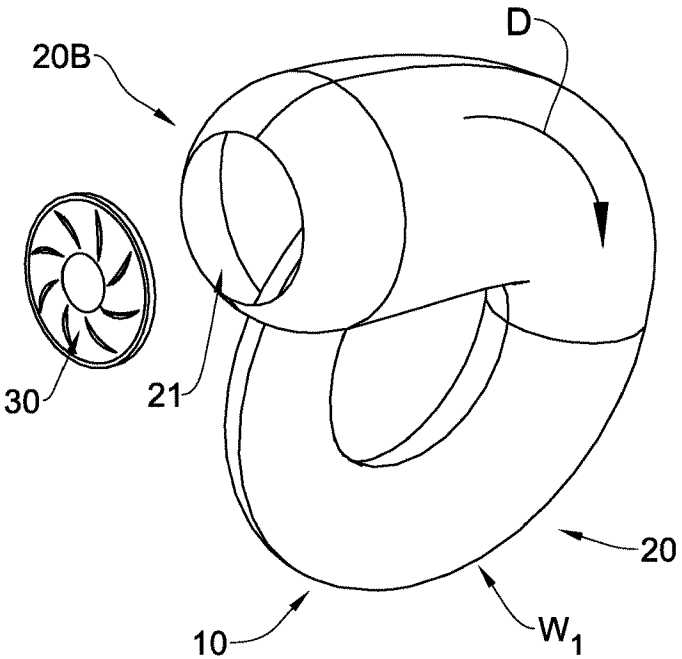
Figure 5D:
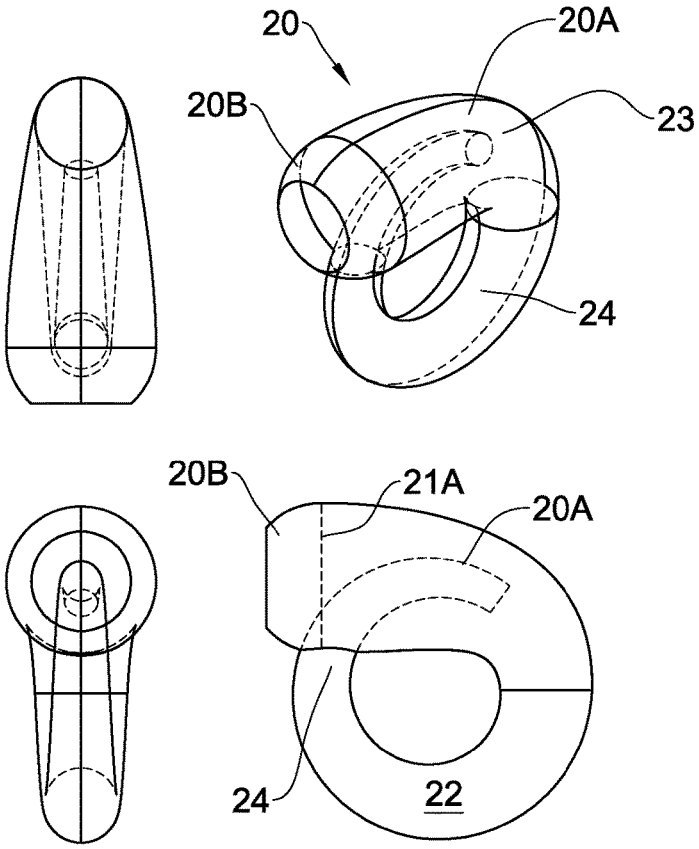
Figure 5E:
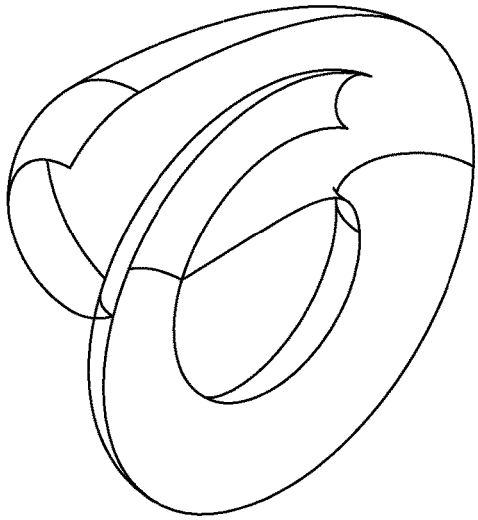

As better shown in FIG. 4, illustrating a top view of the housing 20, the input end 24A of the perpetual self-feeding loop element 24 located at the back side of the site 21 is associated with the outer segment of the spiral-like path, while the output end 24A is associated with the inner segment of the spiral-like path far away from the sound source site 21. As illustrated in this specific and not limiting example, the output end 24A is substantially aligned with the input end 24B. Generally, such closed-loop spiral-like structure 24, whose input end is associated with the back side of the sound source site, is configured as a volumetric structure and has its output end located within the volume defined by the structure.

The above is one of a many possible non-limiting examples of the implementation of the principles of the invention. Generally, the invention provides the acoustic cavity 22 (extending between the back side 21A of the sound source site and the proximal end 20A of the housing) is configured to define the perpetual self-feeding loop structure 24. Such perpetual self-feeding loop structure 24 actually presents a closed-loop waveguide channel $W_1$ (resonator) for backwave propagation sound $S_{B\text{-}W}$ originated at the speaker unit (located at site 21) such that the backwave propagation sound is caused to circulate in the closed-loop channel $W_1$. By this, the backwave propagation sound is prevented from interacting with forward generated sound waves and from reaching the output of the earphone/headphone (from reaching the listener). Indeed, such configuration of the housing 20 and acoustic cavity 22 thereinside, with the perpetual self-feeding loop structure 24 (at times referred to as "spiral-like structure" (element/partition) at the back side 21A of the sound source site 21, provides that the forward generated waves and backward generated waves propagate along substantially spatially separated paths (through path TP and substantially closed loop path SP). Hence, interaction between these waves is prevented or at least significantly reduced, and the backward generated waves are substantially prevented from propagating to and reaching the distal open-end portion 20B of the housing.

The following are various further examples/embodiments of the earphone/headphone device of the invention having different configurations of the housing 20 and its acoustic cavity 22. In all these embodiments, the acoustic cavity comprises/defines the perpetual self-feeding loop structure 24 operating as a closed-loop waveguide channel $W_1$ (resonator) causing backwave propagation sound $S_{B\text{-}W}$ originated at the sound source (located at site 21) to circulate in the closed-loop channel $W_1$. To facilitate illustration and understanding, the device components that are functionally common in all the examples of the invention are identified by the same reference numbers.

Reference is made together to FIGS. 5A-5E showing various views of an exemplary housing 20 configured for use as an acoustic enclosure in the earphone/headphone device 10 of the invention. As shown, the housing 20 has proximal and distal end portions 20A and 20B, a sound source site 21 (for mounting a sound source/speaker unit 30 inside the housing 20) typically closer to the distal end portion 20B. The acoustic cavity 22 is defined by an inner space of the housing between the back side 21A and the proximal end portion 20A.

In some embodiments of the present inventions (e.g. that of FIGS. 5A-5E) a cross sectional dimension (e.g. diameter) of the interior of the housing 20 reduces from the distal end portion 20B (or at least from back side 21A) towards the proximal end portion 20A. Also, as shown in this example, the housing 20 may have a horn-like configuration. The acoustic cavity portion 22 of the housing 20 forms a turn such that the proximal end portion 22A defines/has an aperture 23 forming a fluid coupling of the acoustic cavity 22 with itself at a certain location L of the acoustic cavity portion. Thus, the housing 20 (its acoustic cavity portion 22) has a toroidal-like (e.g. closed-loop/ring-like) configuration formed by connection of the acoustic cavity portion 22 with itself.

This configuration of the housing 20 creates the acoustic cavity 22 forming the perpetual self-feeding loop structure 24 defining as a closed-loop waveguide channel $W_1$ for circulation of backwave propagation sound $S_{B\text{-}W}$ originated at the sound source site 21. In this example, the waveguide channel $W_1$ (acoustic cavity 22) has a varying inner cross-sectional dimension along its length, i.e. reducing from the distal end portion 20B towards the proximal end portion 20A.

In this example the acoustic cavity 22 is configured as a reverse-horn like structure, where the narrow tail (proximal end portion 20A of the housing/of the acoustic cavity) feeds back into the wide mouth (intersecting with the distal portion 21A of the acoustic cavity) forming the infinite loop. Also, in this example, the narrow tail enters and extends along the acoustic cavity substantially along a central portion thereof defining the concentric self-feeding perpetual loop structure 24.

Figure 6A:
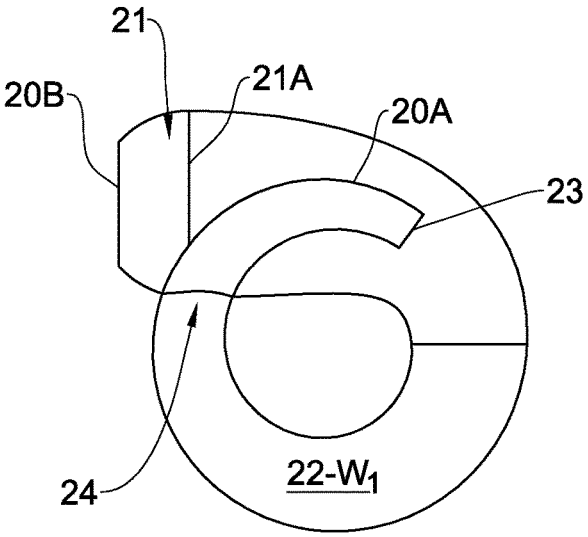
FIGS. 6A-6B exemplify an earphone device according to some embodiments of the invention, utilizing the housing having horn-like configuration defining an acoustic cavity forming the non-concentric self-feeding perpetual loop.
Figure 6B:
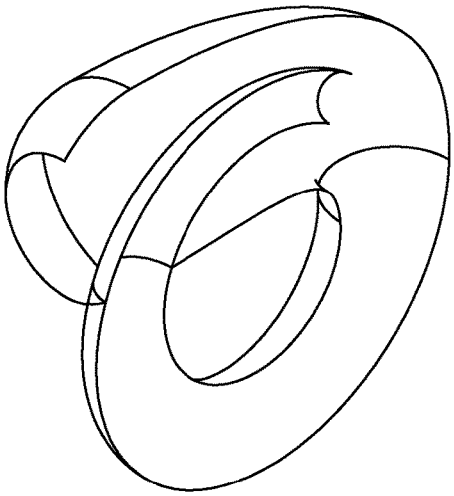
Figure 7C:
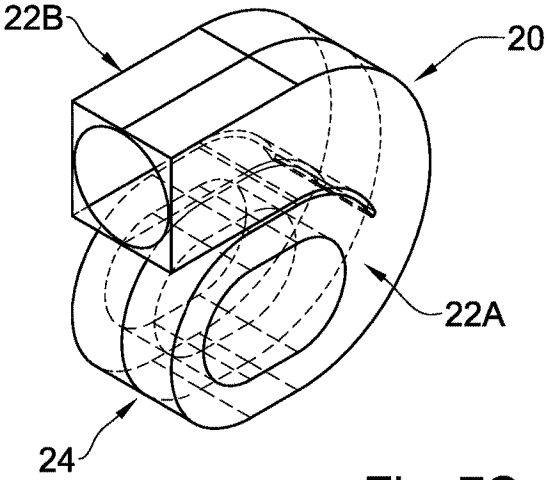
FIGS. 7A-7D show yet further example of an earphone device according to some embodiments of the invention, utilizing the housing having horn-like configuration.
Figure 7B:
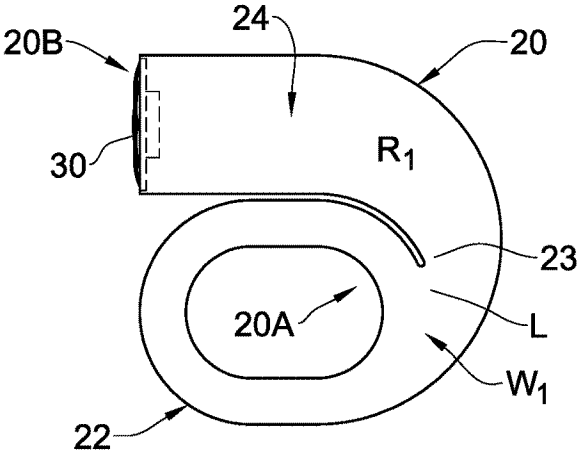
Figure 7D:
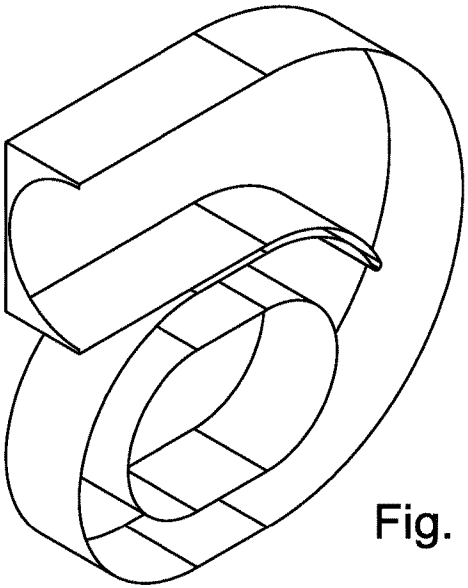
Figure 7A:
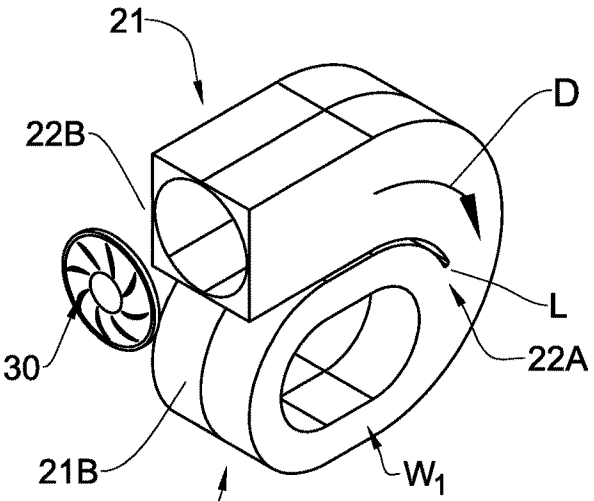
Figure 8A:
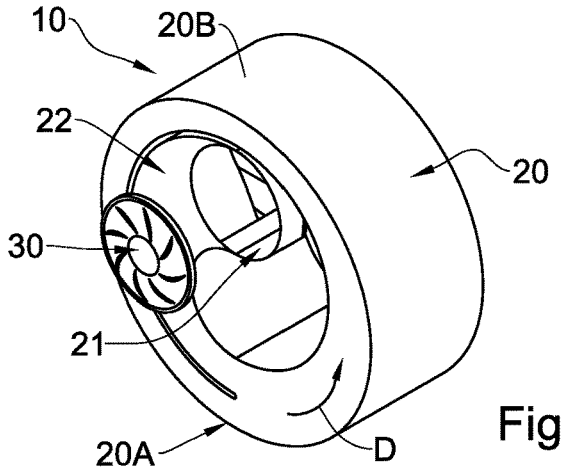
FIGS. 8A-8E show one more example of an earphone device according to some embodiments of the invention, utilizing the housing having horn-like configuration.
Figure 8B:
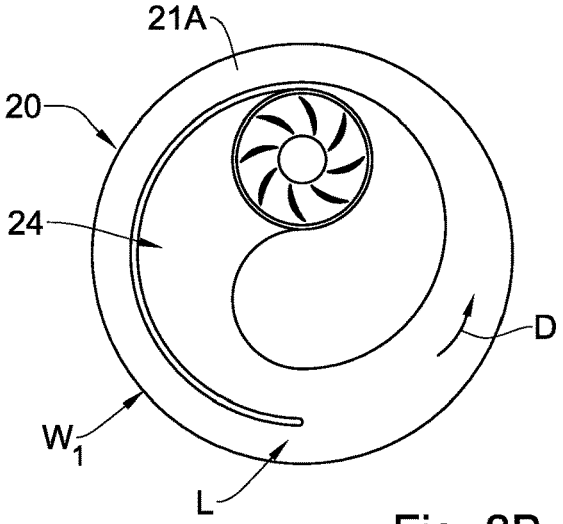
Figure 8C:
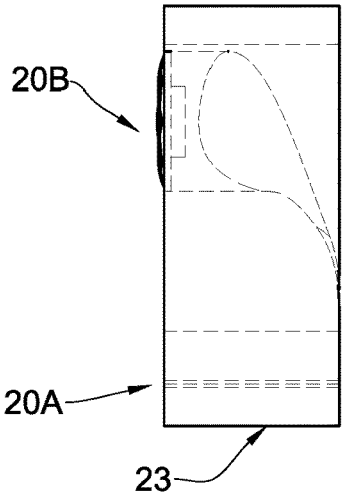
Figure 8D:
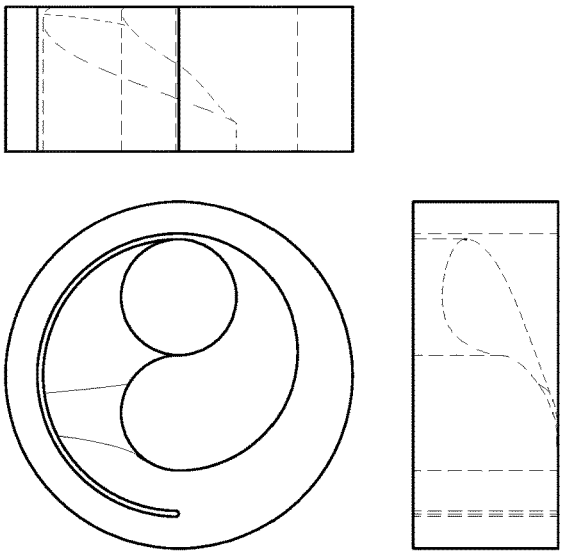
Figure 8E:
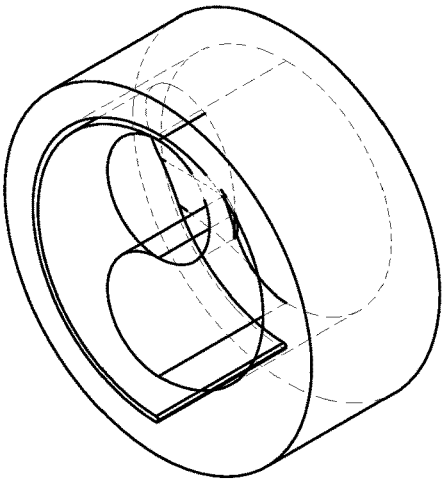
Figures 9A, 9B, 9C, 9D:
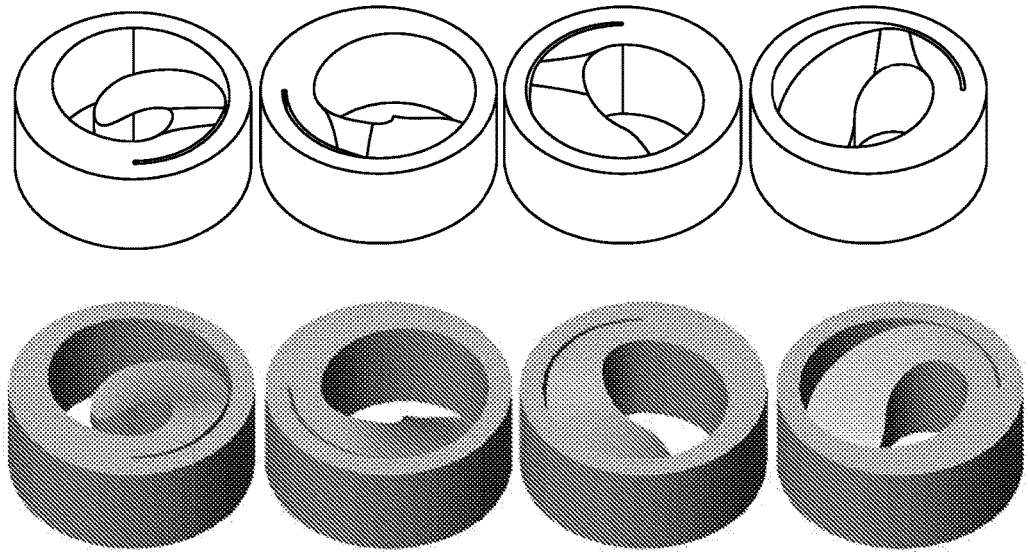
FIGS. 9A-9D exemplify various designs of the device based on the example of FIGS. 8A-8E.
Figures 10A, 10B, 10C:
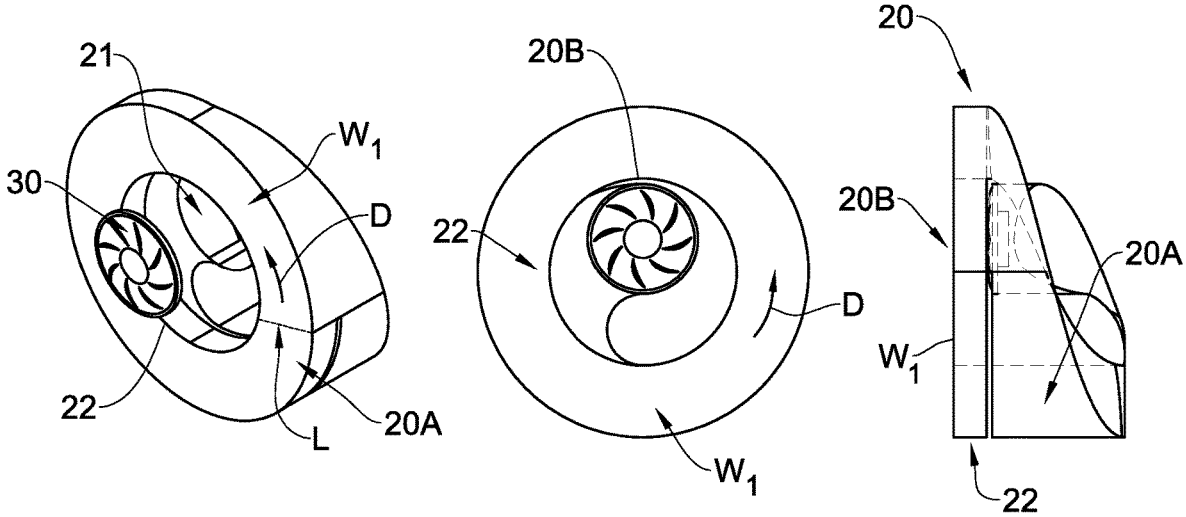
FIGS. 10A-10C exemplify yet another embodiment of the device of the invention utilizing a funnel-like configuration of the acoustic cavity portion of the housing.
Figure 11A:
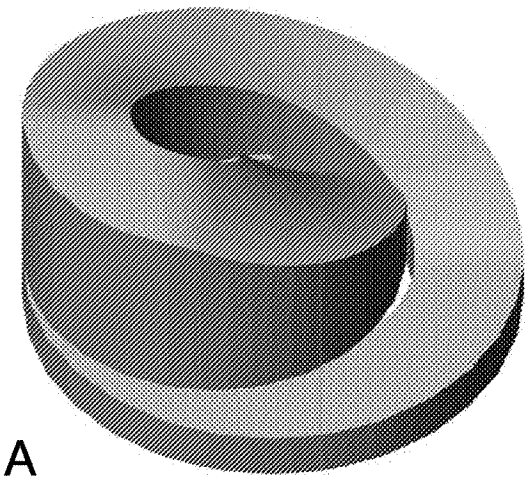
FIGS. 11A-11C show a few more examples of the device configuration based on the principles of the invention.
Figure 11B:
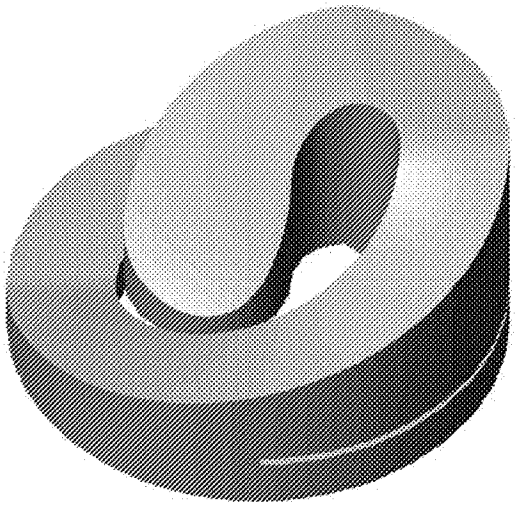
Figure 11C:
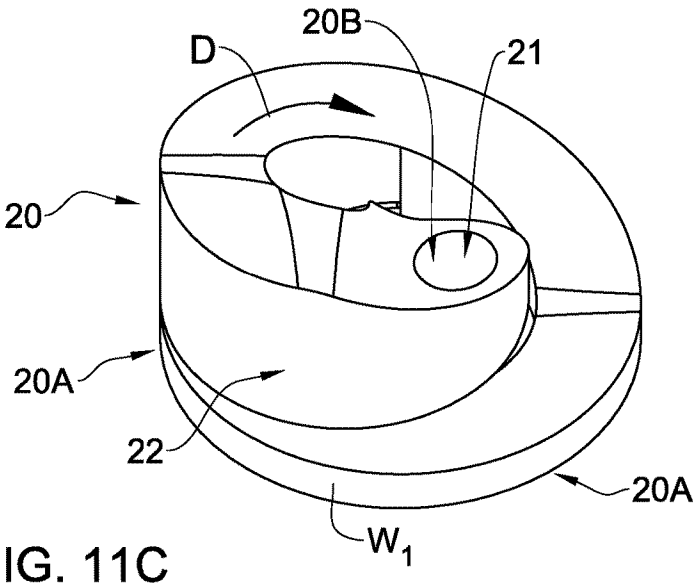
Figure 11D:
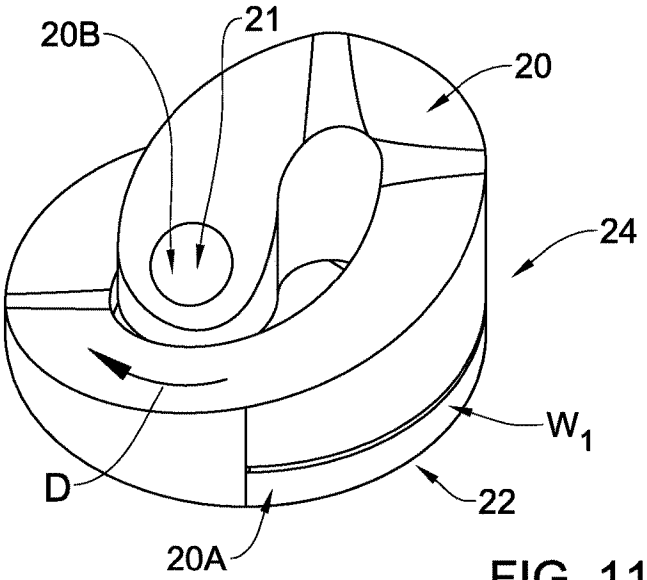

Referring to FIGS. 6A and 6B, there is exemplified an acoustic enclosure 20, which is configured generally similar to the above-described example, namely the horn-like configuration of the acoustic cavity 22. In distinction to the above-described example where the acoustic cavity defines the concentric self-feeding perpetual loop structure, in the example of FIGS. 6A-6B the horn structure is not concentric. Here, the tail portion 20A feeds into a lower part of the mouth and not at its center, i.e. into a peripheral portion of the housing at the distal portion 21A of the acoustic cavity 22 (at the back side 21A of the sound source site 21).

It should be understood that for the purposes of the present invention, the manner in which the tail portion 20A (proximal end portion of the acoustic cavity) feeds back into the acoustic cavity portion 22 (e.g. it could also be biased left or right), provided the tail portion penetrates the horn-like acoustic cavity 22 to form the loop.

Reference is made to FIGS. 7A-7D showing yet another example of the earphone device 10 of the invention, having a housing 20 defining the horn-like acoustic cavity 22 extending between its proximal and distal end portions 21A and 20A. In this example, the tail 20A of the horn-like configuration does not self-intersect and penetrate at the wider portion of the cavity 22. Here, the self-feeding perpetual loop is created using a "junction" L where the mouth of the horn (region $R_1$ closer to the distal portion 21A of the acoustic cavity 22) and the tail portion 20A of the horn merge into a single path. In this case, the mouth-region $R_1$ of the horn and the tail 20A of the horn are stacked one above the other. Also, in this example the horn is not round but have corners, e.g. has square/rectangular cross sectional profile. The horn may have any suitable cross sectional shape/profile.

Reference is made to FIGS. 8A-8E exemplifying the device configuration generally similar to that of FIGS. 7A-7D in that the tail portion 20A does not intersect the horn and the two paths merge while being stacked one above the other. However, the configuration of FIGS. 8A-8E exemplifies the horn structure 24 which is not in-line with the direction D of the speaker unit, but has a funnel-like geometry, generally similar to that of FIGS. 1-4, but which directs the backwave into the perpetual loop that circles in space around the sound source site 21. It should be understood that this is just a different spatial design, while the inside of the housing is configured according to the general concept of the invention, i.e. the acoustic cavity for backwaves propagation extends between the region at the back side 21A of the sound source site 21 (which in the horn-like design presents a "mouth" region/portion) and the end portion 20A (tail portion) and forms the self-feeding perpetual loop structure 24.

FIGS. 9A-9D show various examples of the above-described spatial design of the earphone device, in which the back-waves are directed into the perpetual loop structure 24 that circles in space around the sound source site 21.

Reference is now made to FIGS. 10A-10C and 11A-D showing yet further possible configuration of the earphone device of the invention. In these examples, the configuration of the housing 20 is generally similar to that of the above described examples, namely has a funnel like configuration directing the backwaves into a loop circling in space around the driver 21. Also, these examples are similar to the above-described examples in that they have no self-intersecting geometry. These examples, however, are different from the previously described ones in that the tail and mouth portions of the horn are stacked one in front of the other (on the depth axis), instead of being stacked one above the other.

It should be noted that the actual dimensions of the earphone may be of any suitable design. It may have a large over-the-ear design or designed as a small in-ear system. The earphone of any suitable design, configured according to the invention, has the acoustic cavity 22 (inner cavity of the housing 20) located behind the sound source site 21 (i.e. extending between the back side 21A of the sound source site 21 and the end portion 20A of the housing) configured/shaped to form self-feeding the perpetual loop structure 24.

The invention claimed is:

1. A housing for an earphone or headphone device, the housing having proximal and distal ends defining respectively, a proximal closed-end portion and a distal open-end portion of the device, the housing comprising a sound source site for mounting a sound source in said site inside the housing, and an acoustic cavity extending from a back side of the sound source site and the proximal end portion of the housing, wherein the proximal end portion of the housing enters an inside of the acoustic cavity at a location thereof closer to said back side of the sound source site and passes along a part of the acoustic cavity thereinside, thereby providing fluid coupling of the acoustic cavity with itself, wherein said acoustic cavity is configured to define a perpetual self-feeding closed-loop structure for backwave sound originated at the sound source site, such that said backwave sound is trapped and circulates in the closed-loop structure.

2. The housing of claim 1, wherein said acoustic cavity comprises a spiral-like structure extending from said back side of the sound source site towards the proximal end of the housing, and configured to define a substantially closed-loop spiral path, thereby defining said perpetual self-feeding closed-loop structure.

3. The housing of claim 1, wherein at least a portion of the housing containing said acoustic cavity has a substantially frustum-conical geometry with narrower and wider ends at, respectively, said back side of the sound source site and the proximal end portion.

4. The housing of claim 1, wherein said acoustic cavity has a perpetual self-feeding loop geometry, thereby defining said perpetual self-feeding closed-loop structure for the backwave sound propagation.

5. The housing of claim 4, wherein said acoustic cavity has a horn-like configuration, a region of the acoustic cavity at said back side of the sound source site and the end portion of the housing defining, respectively, mouth and tail portions of the horn.

6. The housing of claim 1, wherein the acoustic cavity forms a concentric configuration of the self-feeding perpetual loop structure.

7. The housing of claim 5, wherein the mouth and the tail portions of the horn-like structure are stacked one above the other, creating a junction where the mouth and the tail portions merge into a single path, thereby forming said perpetual self-feeding loop structure.

8. The housing of claim 5, wherein a portion of the housing containing the acoustic cavity has a funnel-like geometry, enclosing a portion of the housing containing the sound source site.

9. The housing of claim 8, wherein the mouth and the tail portions of the horn-like structure are stacked one above the other.

10. The housing of claim 8, wherein the mouth and the tail portions of the horn-like structure are stacked one in front of the other.

11. An earphone or headphone device comprising the housing configured according to claim 1, and a sound source located at said sound source site, thereby defining a through path for propagation of forward generated sound waves from a front side of the sound source towards the distal open-end portion, and causing backward generated sound waves emerging the sound source at the back side thereof to circulate in the perpetual self-feeding closed-loop structure of the acoustic cavity.

12. The device of claim 11, comprising an ear pad mounted on the distal end of the housing.

* * * * *